US009135865B2

(12) United States Patent
Yang et al.

(10) Patent No.: US 9,135,865 B2
(45) Date of Patent: Sep. 15, 2015

(54) IMAGE DISPLAY APPARATUS AND IMAGE OPTIMIZATION METHOD THEREOF

(71) Applicant: Novatek Microelectronics Corp., Hsinchu (TW)

(72) Inventors: Chih-Yuan Yang, Hsinchu County (TW); Yu-Hsing Chuang, Hsinchu (TW); Feng-Ting Pai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 92 days.

(21) Appl. No.: 14/077,176

(22) Filed: Nov. 11, 2013

(65) Prior Publication Data

US 2015/0009192 A1 Jan. 8, 2015

(30) Foreign Application Priority Data

Jul. 5, 2013 (TW) ..... 102124197 A

(51) Int. Cl.
*G09G 5/10* (2006.01)
*G09G 3/34* (2006.01)

(52) U.S. Cl.
CPC ..... *G09G 3/3406* (2013.01); *G09G 2360/144* (2013.01); *G09G 2360/16* (2013.01)

(58) Field of Classification Search
CPC ..... G09G 5/10; G09G 3/3406; G09G 3/36; G09G 5/00; G06F 3/038
USPC ..... 345/76, 77, 207, 690
See application file for complete search history.

(56) References Cited

U.S. PATENT DOCUMENTS

| | | | | |
|---|---|---|---|---|
| 8,797,346 | B2 * | 8/2014 | Park et al. | 345/590 |
| 8,797,368 | B2 * | 8/2014 | Yoo et al. | 345/690 |
| 2006/0267923 | A1 * | 11/2006 | Kerofsky | 345/102 |
| 2008/0165397 | A1 * | 7/2008 | Lin | 358/520 |
| 2009/0058873 | A1 | 3/2009 | Brown Elliott et al. | |
| 2009/0109165 | A1 * | 4/2009 | Park et al. | 345/102 |
| 2010/0090999 | A1 * | 4/2010 | Komiya | 345/207 |
| 2011/0051100 | A1 * | 3/2011 | Lee et al. | 353/85 |

FOREIGN PATENT DOCUMENTS

| | | |
|---|---|---|
| TW | 201013627 | 4/2010 |
| TW | 201305998 | 2/2013 |

OTHER PUBLICATIONS

"Office Action of Taiwan Counterpart Application", issued on May 25, 2015, p. 1-p. 3.

* cited by examiner

*Primary Examiner* — Pegeman Karimi
(74) *Attorney, Agent, or Firm* — Jianq Chyun IP Office

(57) ABSTRACT

An image display apparatus and an image optimization method are provided. The image display apparatus includes an image content analyzer, a luminance compensator, and an image optimization processor The image content analyzer receives image data and ambient luminance and generates a backlight luminance adjustment value according to the image data and the ambient luminance. The luminance compensator generates an image data luminance adjustment value according to the backlight luminance adjustment value and generates first image data by adjusting the luminance of the image data according to the image data luminance adjustment value. The image optimization processor generates a saturation adjustment weight according to the image data luminance adjustment value. According to the saturation adjustment weight, the image optimization processor generates output image data by adjusting the luminance of the first image data.

13 Claims, 3 Drawing Sheets

IMAGE DISPLAY APPARATUS AND IMAGE OPTIMIZATION METHOD THEREOF

CROSS-REFERENCE TO RELATED APPLICATION

This application claims the priority benefit of Taiwan application serial no. 102124197, filed on Jul. 5, 2013. The entirety of the above-mentioned patent application is hereby incorporated by reference herein and made a part of this specification.

BACKGROUND OF THE INVENTION

1. Field of the Invention

The invention relates to an image display apparatus, and more particularly to an image display apparatus capable of optimizing an image.

2. Description of Related Art

Due to the popularity of electronic products, designers tend to configure quality display devices on the electronic apparatuses. To meet the requirement for mobility, users need the electronic apparatuses that may achieve satisfactory display effects under any circumstances.

A conventional display apparatus is able to adjust luminance of a backlight module according to the ambient luminance. In bright outdoor environment, however, the luminance of the backlight module is often adjusted to the maximum level in order to prevent the reflection resulting from the strong light, thus leading to significant power consumption. To reduce the power consumption, the luminance of the display image of the conventional display apparatus may be increased, such that the luminance of the backlight module may be correspondingly reduced.

However, the pure increase in the luminance of the display image may deteriorate the quality of the display image and induce undesirable side effects of increasing noise and color distortion, which diminishes the visual effects of the display apparatus. Hence, how to ensure the display quality without consuming excessive power has drawn the attention of designers in this field.

SUMMARY OF THE INVENTION

The invention is directed to an image display apparatus capable of optimizing an image after luminance of image data is adjusted, and thereby the display quality can be improved.

The invention is further directed to an image optimization method suitable for an image display apparatus. Through applying the image optimization method, an image may be optimized after luminance of image data is adjusted, and thereby the display quality can be improved.

In an embodiment of the invention, an image display apparatus that includes an image content analyzer, a luminance compensator, and an image optimization processor is provided. The image content analyzer receives image data and ambient luminance and generates a backlight luminance adjustment value according to the image data and the ambient luminance. The luminance compensator is coupled to the image content analyzer. Here, the luminance compensator generates an image data luminance adjustment value according to the backlight luminance adjustment value and generates first image data by adjusting the luminance of the image data according to the image data luminance adjustment value. The image optimization processor is coupled to the luminance compensator and generates a saturation adjustment weight according to the image data luminance adjustment value. Besides, according to the saturation adjustment weight, the image optimization processor generates output image data by adjusting the luminance of the first image data.

According to an embodiment of the invention, the image optimization processor further calculates a luminance increasing amplitude between the output image data and the first image data and calculates a detail variation in the output image data. In addition, the image optimization processor generates adjusted output image data by adjusting the output image data according to the luminance increasing amplitude and the detail variation.

According to an embodiment of the invention, the image optimization processor obtains the luminance increasing amplitude by calculating a luminance difference between the output image data and the first image data.

According to an embodiment of the invention, the output image data include a plurality of pixel data. The image optimization processor obtains the detail variation by calculating a luminance difference between each of the pixel data and adjacent pixel data of the each of the pixel data.

According to an embodiment of the invention, the image optimization processor obtains a luminance correction weight value according to the luminance increasing amplitude and a luminance increasing amplitude weight function. Additionally, the image optimization processor obtains a detail variation correction weight value according to the detail variation and a detail variation weight function.

According to an embodiment of the invention, the image optimization processor obtains a detail correction weight according to the sum of the luminance correction weight value and the detail variation correction weight value. In addition, the image optimization processor adjusts the output image data according to the detail correction weight, so as to generate the adjusted output image data.

According to an embodiment of the invention, the image optimization processor generates the saturation adjustment weight according to a saturation adjustment weight function and the image data luminance adjustment value. Here, the saturation adjustment weight and the image data luminance adjustment value are in inverse proportion to each other.

In an embodiment of the invention, an image optimization method suitable for an image display apparatus is provided. The method includes: receiving image data and ambient luminance and generating a backlight luminance adjustment value according to the image data and the ambient luminance; generating an image data luminance adjustment value according to the backlight luminance adjustment value and generating first image data by adjusting luminance of the image data according to the image data luminance adjustment value; generating a saturation adjustment weight according to the image data luminance adjustment value and generating output image data by adjusting luminance of the first image data according to the saturation adjustment weight.

In view of the above, the luminance of image data is adjusted by changing the backlight luminance, and saturation of the adjusted image data is also adjusted, so as to further optimize the to-be-displayed image and enhance the performance of the image display apparatus described herein.

Several exemplary embodiments accompanied with figures are described in detail below to further describe the invention in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the invention.

DETAILED DESCRIPTION OF DISCLOSED EMBODIMENTS

Figure 1:
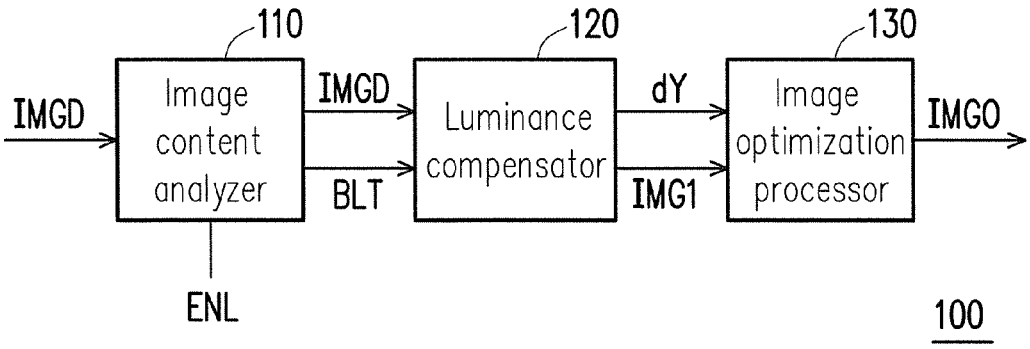
FIG. 1 is a schematic diagram illustrating an image display apparatus 100 according to an embodiment of the invention.

FIG. 1 is a schematic diagram illustrating an image display apparatus 100 according to an embodiment of the invention. The image display apparatus 100 includes an image content analyzer 110, a luminance compensator 120, and an image optimization processor 130. The image content analyzer 110 receives image data IMGD and ambient luminance ENL. The image content analyzer 110 also generates a backlight luminance adjustment value BLT according to the image data IMGD and the ambient luminance ENL.

The backlight luminance adjustment value BLT is transmitted to the luminance compensator 120 that is coupled to the image content analyzer 110. The luminance compensator 120 generates an image data luminance adjustment value and an image data luminance adjustment ratio according to the backlight luminance adjustment value BLT. Besides, the luminance compensator 120 generates first image data IMG1 by adjusting the luminance of the image data IMGD according to the image data luminance adjustment value and the image data luminance adjustment ratio. For instance, the image data IMGD may include first color light image data RIN, second color light image data GIN, and third color light image data BIN. According to the backlight luminance adjustment value BLT, the luminance compensator 120 generates the image data luminance adjustment value dY and the image data luminance adjustment ratio RATIO and thereby generates the first image data IMG1 containing the first color light image data RIN, the second color light image data GIN, and the third color light image data BIN. The way to calculate the first color light image data RIN, the second color light image data GIN, and the third color light image data BIN is represented by the following equation (1):

$$RIN1=\text{RATIO}\times RIN1+dY$$

$$GIN1=\text{RATIO}\times GIN1+dY$$

$$BIN1=\text{RATIO}\times BIN1+dY \quad (1)$$

If, for instance, the backlight luminance of the image display apparatus 100 is reduced according to the backlight luminance adjustment value BLT, the image data luminance adjustment ratio RATIO may be greater than 1 and may serve to increase the luminance of the image data IMGD, so as to generate the first image data IMG1. The image data luminance adjustment value dY may be applied to determine whether to adjust the saturation of the image data IMGD or not. When the image data luminance adjustment value dY is greater than 0, the saturation of the image data IMGD is reduced; when the image data luminance adjustment value dY is less than 0, the saturation of the image data IMGD is increased; when the image data luminance adjustment value dY is equal to 0, the saturation of the image data IMGD remains unchanged.

The image optimization processor 130 is coupled to the luminance compensator 120. Besides, the image optimization processor 130 calculates to generate a saturation adjustment weight according to the image data luminance adjustment value dY. According to the calculated saturation adjustment weight, the image optimization processor 130 generates output image data IMGO by adjusting the luminance of the first image data IMG1. Here, the saturation adjustment weight W_sat may be calculated by the following equation (2):

$$\text{Saturation}=\frac{\text{Max}(RIN, GIN, BIN)-\text{Min}(RIN, GIN, BIN)}{\text{Max}(RIN, GIN, BIN)} \quad (2)$$

$$=\text{W_sat}\times\frac{\text{Max}(RIN1, GIN1, BIN1)-\text{Min}(RIN1, GIN1, BIN1)}{\text{Max}(RIN1, GIN1, BIN1)+dY}$$

Here, Max is calculated by obtaining the maximum value among the numerical values in the corresponding parentheses, and Min is calculated by obtaining the minimum value among the numerical values in the corresponding parentheses.

Figure 2:
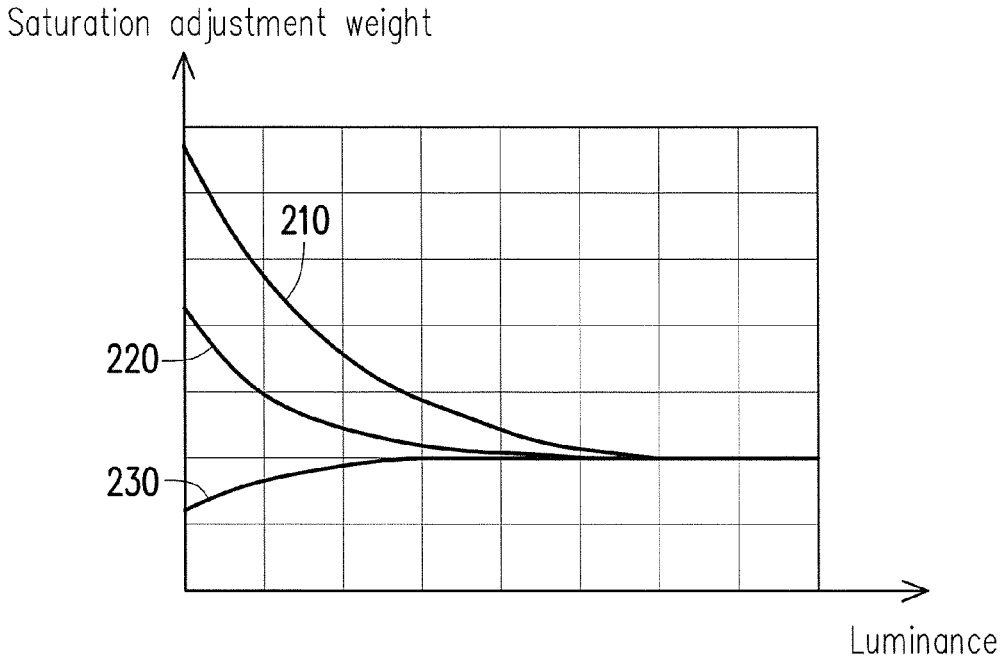
FIG. 2 is a curve diagram illustrating a saturation adjustment weight function according to an embodiment of the invention.

Next, please refer to both FIG. 1 and FIG. 2. Specifically, FIG. 2 is a curve diagram illustrating a saturation adjustment weight function according to an embodiment of the invention. Here, the saturation adjustment weight W_sat may be calculated by the saturation adjustment weight function shown in FIG. 2. In FIG. 2, the curve 210 indicates the relationship between the image luminance and the saturation adjustment weight W_sat when the image data luminance adjustment value dY is greater than 0; the curve 220 indicates the relationship between the image luminance and the saturation adjustment weight W_sat when the image data luminance adjustment value dY is equal to 0; the curve 230 indicates the relationship between the image luminance and the saturation adjustment weight W_sat when the image data luminance adjustment value dY is less than 0. As the image luminance increases, the curves 210 to 230 are all converged as if the saturation adjustment weight W_sat is equal to 1. That is, when the saturation adjustment weight W_sat is greater than 1, the saturation of the image data IMGD is increased; when the saturation adjustment weight W_sat is equal to 1, the saturation of the image data IMGD stays unchanged; when the saturation adjustment weight W_sat is less than 1, the saturation of the image data IMGD is decreased. Here, the saturation adjustment weight W_sat and the image data IMGD are in inverse proportion to each other.

According to the above-mentioned equation (2), the image optimization processor 130 may calculate the saturation adjustment weight W_sat through arithmetic computation. Certainly, in FIG. 2, the curves 210 to 230 indicating the relationship between the saturation adjustment weight W_sat and the image luminance may also be recorded in one or more lookup tables. Through the lookup table, the image optimization processor 130 is also allowed to obtain the saturation adjustment weight W_sat.

In another aspect, the image data IMGO may be calculated according to the saturation adjustment weight W_sat by means of the following equation (3) expressing the relationship between the output image data IMGO and the saturation adjustment weight W_sat:

$$RO=W_\text{sat}*RIN1+\tfrac{1}{2}*(1-W_\text{sat})*(GIN1+BIN1)$$

$$GO=W_sat*GIN1+\tfrac{1}{2}*(1-W_sat)*(RIN1+BIN1)$$

$$BO=W_sat*BIN1+\tfrac{1}{2}*(1-W_sat)*(GIN1+RIN1) \quad (3)$$

Here, RO, GO, and BO refer to the three color light image data included in the output image data IMGO. The image optimization processor 130 may obtain the output image data IMGO through directly performing the arithmetic computation by means of the equation (3). It is also likely for the image optimization processor 130 to establish a lookup table that records the output image data IMGO, the first image data IMG1, and the saturation adjustment weight W_sat according to the equation (3) and generates the output image data IMGO based on the saturation adjustment weight W_sat by searching the lookup table.

From another perspective, the image optimization processor 130 may further adjust the output image data IMGO. Particularly, the image optimization processor 130 further calculates a luminance increasing amplitude dY2 between the output image data IMGO and the first image data IMG1 and calculates a detail variation in the output image data IMGO. According to the luminance increasing amplitude dY2 and the detail variation, the image optimization processor 130 generates the adjusted output image data.

Note that the image optimization processor 130 may obtain the luminance increasing amplitude dY2 by calculating a luminance difference between the output image data IMGO and the first image data IMG1. The image optimization processor 130 may also obtain the detail variation by performing computation on the pixel data included in the output image data IMGO. To be specific, the image optimization processor 130 obtains the detail variation by calculating a luminance difference between each of the pixel data and adjacent pixel data of the each of the pixel data.

Figure 3:
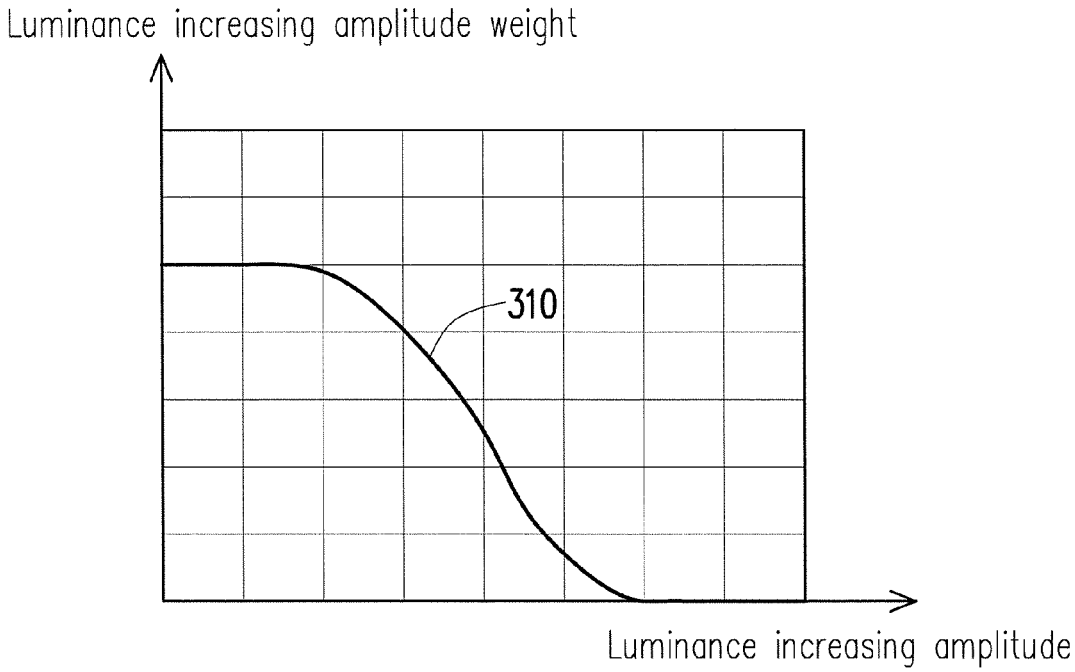
FIG. 3 is a schematic diagram illustrating a luminance increasing amplitude weight function according to an embodiment of the invention.
Figure 4:
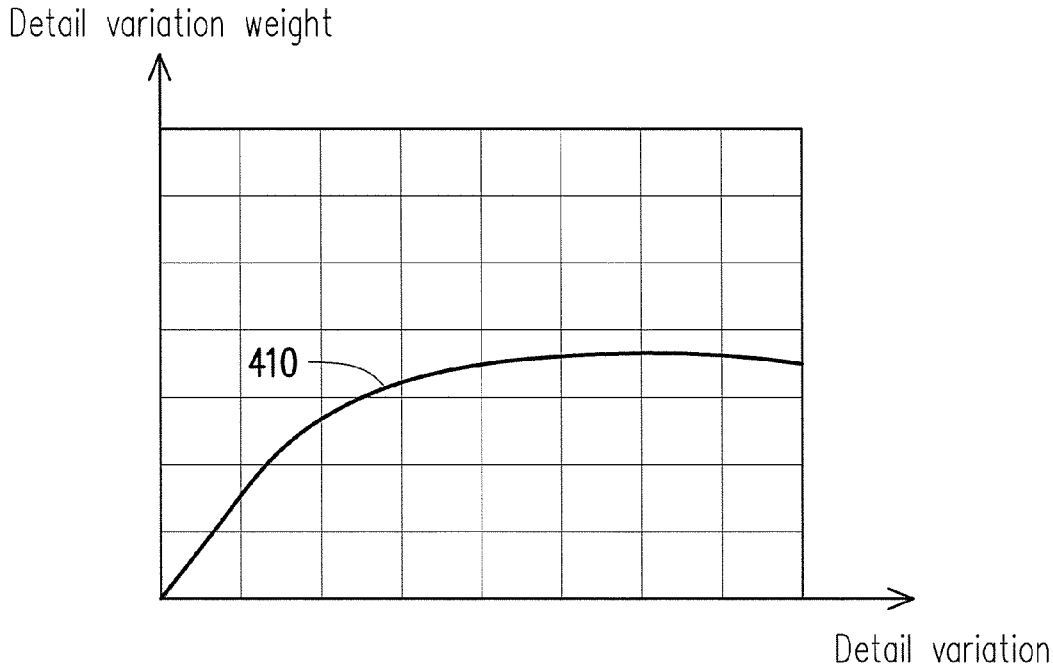
FIG. 4 is a schematic diagram illustrating a detail variation weight function according to an embodiment of the invention.

Please refer to FIG. 1, FIG. 3, and FIG. 4 together. FIG. 3 is a schematic diagram illustrating a luminance increasing amplitude weight function according to an embodiment of the invention. FIG. 4 is a schematic diagram illustrating a detail variation weight function according to an embodiment of the invention. The curve 310 shown in FIG. 3 represents the relationship between the luminance increasing amplitude and the luminance increasing amplitude weight in the luminance increasing amplitude weight function according to an embodiment of the invention. Here, the luminance increasing amplitude and the luminance increasing amplitude weight are in inverse proportion to each other, as shown by the curve 310. The image optimization processor 130 may calculate the luminance increasing amplitude weight according to the calculated luminance increasing amplitude dY2. The curve 410 shown in FIG. 4 represents the relationship between the detail variation and the detail variation weight in the detail variation weight function according to an embodiment of the invention. Here, the detail variation and the detail variation weight are in inverse proportion to each other, as shown by the curve 410. In addition, if the detail variation is overly large, the detail variation weight approaches a constant value.

The image optimization processor 130 then adds the obtained luminance increasing amplitude weight and the detail variation weight together to generate a detail correction weight, and the image optimization processor 130 adjusts the output image data IMGO according to the detail correction weight, so as to generate the adjusted output image data IMGTO.

The image optimization processor 130 may generate the adjusted output image data IMGTO by means of the following equation (4):

$$RTO=RO+dY2\times EDW$$

$$GTO=GO+dY2\times EDW$$

$$BTO=BO+dY2\times EDW \quad (4)$$

Here, RTO, GTO, and BTO refer to the three color light image data included in the adjusted output image data IMGTO, and EDW denotes the detail correction weight.

Figure 5:
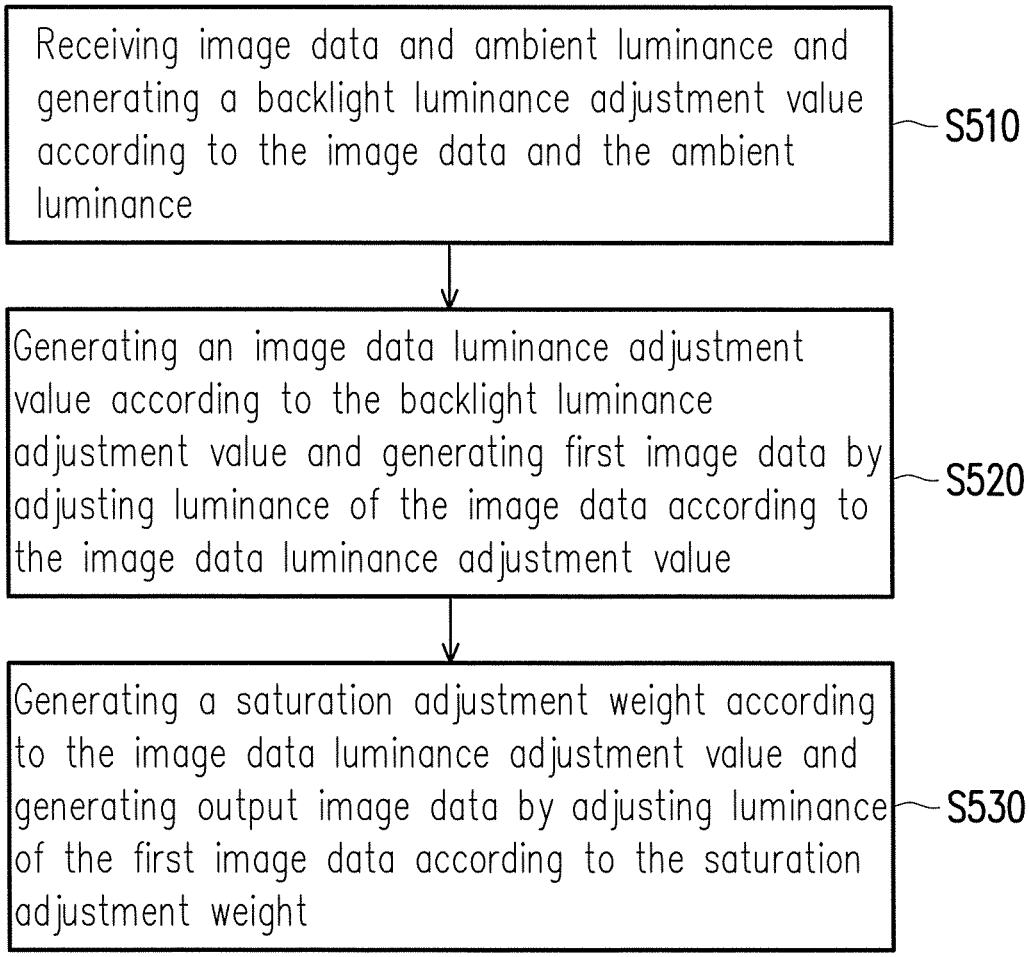
FIG. 5 is a flow chart illustrating an image optimization method according to an embodiment of the invention.

FIG. 5 is a flow chart illustrating an image optimization method according to an embodiment of the invention. The image optimization method includes: receiving image data and ambient luminance and generating a backlight luminance adjustment value according to the image data and the ambient luminance (step S510); generating an image data luminance adjustment value according to the backlight luminance adjustment value and generating first image data by adjusting luminance of the image data according to the image data luminance adjustment value (step S520); generating a saturation adjustment weight according to the image data luminance adjustment value and generating output image data by adjusting luminance of the first image data according to the saturation adjustment weight (step S530).

The detailed illustrations of each step in the embodiment are already elaborated in above embodiments and thus will not be further provided hereinafter.

To sum up, in the invention, the luminance of the image data is adjusted in response to the backlight luminance adjustment value, and the image data may also be adjusted in consideration of the saturation of the image. Thereby, in the image display apparatus described herein, the luminance of the backlight module is monitored for reducing the power consumption, and favorable image display quality can also be guaranteed. As a result, the relevant costs may be decreased, and the performance of the image display apparatus may be optimized.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An image display apparatus comprising:

an image content analyzer receiving image data and ambient luminance and generating a backlight luminance adjustment value according to the image data and the ambient luminance;

a luminance compensator coupled to the image content analyzer, the luminance compensator generating an image data luminance adjustment value and an image data luminance adjustment ratio according to the backlight luminance adjustment value and generating first image data by adjusting luminance of the image data according to the image data luminance adjustment value and the image data luminance adjustment ratio; and an image optimization processor coupled to the luminance compensator, the image optimization processor generating a saturation adjustment weight according to the image data luminance adjustment value and generating output image data by adjusting luminance of the first image data according to the saturation adjustment weight.

2. The image display apparatus as recited in claim 1, wherein the image optimization processor further calculates a luminance increasing amplitude between the output image data and the first image data and calculates a detail variation in the output image data, and the image optimization processor generates adjusted output image data by adjusting the output image data according to the luminance increasing amplitude and the detail variation.

3. The image display apparatus as recited in claim 2, wherein the image optimization processor obtains the luminance increasing amplitude by calculating a luminance difference between the output image data and the first image data.

4. The image display apparatus as recited in claim 2, wherein the output image data comprise a plurality of pixel data, and the image optimization processor obtains the detail variation by calculating a luminance difference between each of the pixel data and adjacent pixel data of the each of the pixel data.

5. The image display apparatus as recited in claim 2, wherein the image optimization processor obtains a luminance correction weight value according to the luminance increasing amplitude and a luminance increasing amplitude weight function, and the image optimization processor obtains a detail variation correction weight value according to the detail variation and a detail variation weight function.

6. The image display apparatus as recited in claim 5, wherein the image optimization processor obtains a detail correction weight according to the sum of the luminance correction weight value and the detail variation correction weight value, and the image optimization processor adjusts the output image data according to the detail correction weight, so as to generate the adjusted output image data.

7. The image display apparatus as recited in claim 1, wherein the image optimization processor generates the saturation adjustment weight according to a saturation adjustment weight function and the image data luminance adjustment value, and the saturation adjustment weight and the image data luminance adjustment value are in inverse proportion to each other.

8. An image optimization method suitable for an image display apparatus, the image optimization method comprising:

receiving image data and ambient luminance and generating a backlight luminance adjustment value according to the image data and the ambient luminance;

generating an image data luminance adjustment value and an image data luminance adjustment ratio according to the backlight luminance adjustment value and generating first image data by adjusting luminance of the image data according to the image data luminance adjustment value and the image data luminance adjustment ratio; and generating a saturation adjustment weight according to the image data luminance adjustment value and generating output image data by adjusting luminance of the first image data according to the saturation adjustment weight.

9. The image optimization method as recited in claim 8, further comprising:

calculating a luminance increasing amplitude between the output image data and the first image data;

calculating a detail variation in the output image data; and generating adjusted output image data by adjusting the output image data according to the luminance increasing amplitude and the detail variation.

10. The image optimization method as recited in claim 9, further comprising:

obtaining the luminance increasing amplitude by calculating a luminance difference between the output image data and the first image data.

11. The image optimization method as recited in claim 9, wherein the output age data comprise a plurality of pixel data, and the image optimization method further comprises:

obtains the detail variation by calculating a luminance difference between each of the pixel data and adjacent pixel data of the each of the pixel data.

12. The image optimization method as recited in claim 9, wherein the step of generating the output image data by adjusting the luminance of the first image data according to the saturation adjustment weight comprises:

obtaining a luminance correction weight value according to the luminance increasing amplitude and a luminance increasing amplitude weight function;

obtaining a detail variation correction weight value according to the detail variation and a detail variation weight function; and adjusting the output image data according to the sum of the luminance correction weight value and the detail variation correction weight value, so as to generate the adjusted output image data.

13. The image optimization method as recited in claim 8, wherein the step of generating the saturation adjustment weight according to the image data luminance adjustment value comprises:

generating the saturation adjustment weight according to a saturation adjustment weight function and the image data luminance adjustment value, wherein the saturation adjustment weight and the image data luminance adjustment value are in inverse proportion to each other.

* * * * *